US011231030B2

(12) United States Patent
Wang

(10) Patent No.: US 11,231,030 B2
(45) Date of Patent: Jan. 25, 2022

(54) DIAPHRAGM PUMP

(71) Applicant: Xiamen Koge Micro Tech Co., Ltd., Xiamen (CN)

(72) Inventor: Si-Cheng Wang, New Taipei (TW)

(73) Assignee: XIAMEN KOGE MICRO TECH CO., LTD., Xiamen (CN)

( * ) Notice: Subject to any disclaimer, the term of this patent is extended or adjusted under 35 U.S.C. 154(b) by 0 days.

(21) Appl. No.: 16/884,301

(22) Filed: May 27, 2020

(65) Prior Publication Data

US 2021/0071658 A1 Mar. 11, 2021

(30) Foreign Application Priority Data

Sep. 11, 2019 (CN) ..... 201910859608.2

(51) Int. Cl.

| | |
|---|---|
| ***F04B 45/047*** | (2006.01) |
| ***F04B 53/10*** | (2006.01) |
| ***F04B 45/04*** | (2006.01) |
| ***F04B 49/22*** | (2006.01) |
| ***F04B 53/06*** | (2006.01) |
| ***F04B 49/035*** | (2006.01) |
| ***F04B 49/08*** | (2006.01) |
| ***F04B 49/10*** | (2006.01) |

(Continued)

(52) U.S. Cl.

CPC ..... *F04B 45/047* (2013.01); *F04B 45/043* (2013.01); *F04B 49/035* (2013.01); *F04B 49/08* (2013.01); *F04B 49/10* (2013.01); *F04B 49/22* (2013.01); *F04B 53/06* (2013.01); *F04B 53/106* (2013.01); *F04B 39/123* (2013.01); *F04B 43/0045* (2013.01); *F04B 43/0063* (2013.01); *F04B 53/1087* (2013.01)

(58) Field of Classification Search

CPC ..... F04B 45/047; F04B 49/035; F04B 49/08; F04B 49/24; F04B 49/10; F04B 53/106; F04B 53/06; F04B 49/22; F04B 45/043; F04B 53/10; F04B 39/12; F04B 53/1087; F04B 43/0063; F04B 43/0045; F04B 39/123

See application file for complete search history.

(56) References Cited

U.S. PATENT DOCUMENTS

| | | | | |
|---|---|---|---|---|
| 2016/0047375 | A1* | 2/2016 | Fukami | F04B 45/043 417/472 |
| 2016/0123315 | A1* | 5/2016 | Fukami | F04B 53/1067 417/472 |
| 2017/0215744 | A1* | 8/2017 | Kawamura | A61B 5/0235 |

* cited by examiner

*Primary Examiner* — Devon C Kramer
*Assistant Examiner* — David N Brandt
(74) *Attorney, Agent, or Firm* — Juan Carlos A. Marquez; Marquez IP Law Office, PLLC

(57) ABSTRACT

A diaphragm pump is revealed. The diaphragm pump includes a pump device, a pump body, a top cover, and an air release valve head. The pump body includes at least two air inlet passages, at least one air outlet passage and at least one leak-proof/sealing passage, all selectively communicating with one cavity. The top cover includes a valve port, an air vent and an air outlet duct. Air pressure in the leak-proof passage acts on the air release valve head so that the valve port is closed by the air release valve head while the pump device is pumping air. The air release valve head and the valve port are separated from each other and then the valve port is communicating with the air outlet duct when the pump device stops pumping air. The pump performance is improved and no air release valve is required.

6 Claims, 7 Drawing Sheets

(51) Int. Cl.
*F04B 39/12* (2006.01)
*F04B 43/00* (2006.01)

DIAPHRAGM PUMP

BACKGROUND OF THE INVENTION

1. Technical Field

The present invention relates to a pump, especially to a diaphragm pump.

2. Description of Related Art

In conventional techniques, devices such as blood pressure meters or massage chairs use diaphragm pumps as pressurizing equipment. Generally, the diaphragm pump doesn't provide air release function. During air discharge, pressurizing equipment needs to use an air release valve arranged separately. Thus not only passages in the pressurizing equipment are getting more complicated, the volume and the cost are also increased.

SUMMARY OF THE INVENTION

Thus there is room for improvement and there is a need to provide a diaphragm pump with novel structure for solving the above problems.

Therefore it is a primary object of the present invention to provide a diaphragm pump which provides both air pump and air release functions.

The present invention provides a diaphragm pump comprising: a pump device which includes a bladder and an electromechanical member while at least two cavities formed in the bladder and a shaft of the electromechanical member connected to the bladder for driving the cavities to move upward and downward so that the cavities are further compressed or expanded; a pump body which includes at least two air inlet passages, at least one air outlet passage and at least one leak-proof passage while the air inlet passages, the air outlet passage and the leak-proof passage selectively communicating with one of the cavities; a top cover connected to the pump body and provided with a valve port, an air vent and an air outlet duct; and an air release valve head mated to the valve port in a separable manner; air pressure in the leak-proof passage acting on the air release valve head so that the valve port is closed by the air release valve head while the pump device pumping air; the air release valve head and the valve port separated from each other when the pump device stops pumping air.

The diaphragm pump provides both air pump and air release functions by rational arrangement of the passage system of the pump body. Thus the performance of the diaphragm pump is optimized and no air release valve is required for the pressurizing device to release air.

Implementation of the present invention produces advantageous effects which are described in detail as follows. Additional features and advantages of the invention will be set forth in the description which follows, and in part will be obvious from the description, or may be learned by the practice of the invention.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
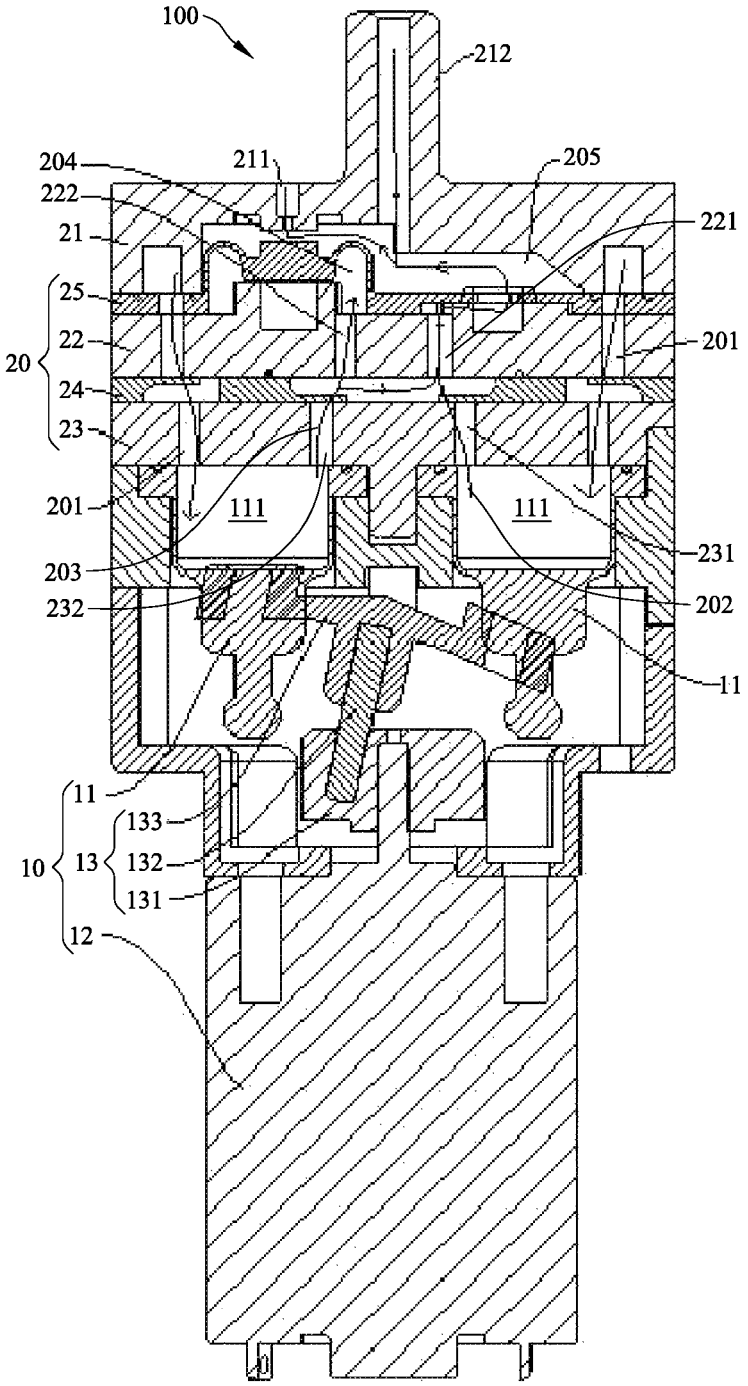
FIG. 1 is a sectional view of an embodiment according to the present invention.

The preferred embodiments of the present invention are described in detail as follows and the embodiments are shown in the figures, wherein the same or similar reference numerals are used to refer to the same or similar elements having the same or similar functions. The embodiments described with reference to the figures are exemplary and explanatory only and the present invention is not intended to be limited to the embodiments described.

Refer to FIG. 1, FIG. 2, FIG. 4, FIG. 7 and FIG. 8, a diaphragm pump 100 according to the present invention mainly includes a pump device 10, a pump body 20, an air release valve head 30 and a top cover 21.

As shown in FIG. 1, FIG. 2, FIG. 7, FIG. 8 and FIG. 9, the pump device 10 consists of a bladder 11, an electromechanical member 12 and, and a connection member 13. At least two cavities 111 are defined and formed in the bladder 11.

A shaft of the electromechanical member 12 is connected to the bladder 11 for driving the cavities 111 to move upward and downward so that the cavities 111 are further compressed or expanded. A connection member 13 disposed between the bladder 11 and the electromechanical member 12 is composed of an eccentric wheel 131, a steel pin 132 and a connecting rod 133. The eccentric wheel 131 is connected to the shaft of the electromechanical member 12 and the steel pin 132 is arranged slantwise between the eccentric wheel 131 and the connecting rod 133 while the connecting rod 133 is connected to the bladder 11. During rotation of the shaft of the electromechanical member 12, the connection member 13 is driven to move synchronously so that the respective cavities 111 are compressed or expanded and the pump device 10 makes air/gas move. The basic working principle of the pump device 10 is easy to understand for a man skilled in the art so that the pump device 10 will not be described in details.

Figure 4:
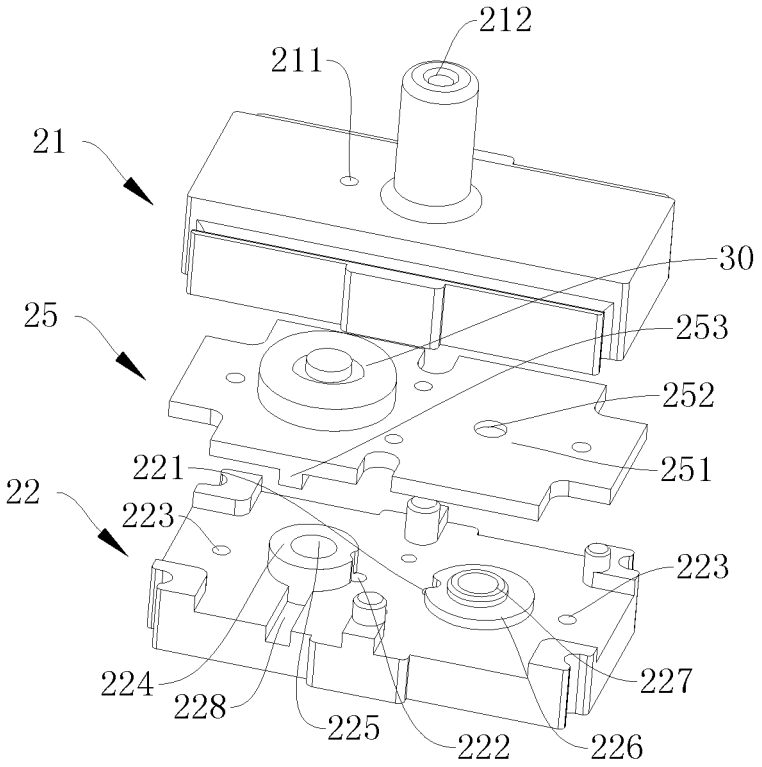
FIG. 4 is an explosive view of a top cover, a second valve membrane and a first valve seat of an embodiment according to the present invention.

Generally, each cavity 111 is disposed corresponding to one air inlet passage 201 and one air outlet passage 202 of the pump body 20. The air is sucked into and flowing out from the respective cavities 111 one after another in turn so as to pump the air/gas to the outside continuously. The present diaphragm pump 100 can also release the air. The top cover 21 of the pump body 20 is provided with a valve port 211 and an air vent which is connected to pressurizing equipment. The pump body 20 further includes at least one leak-proof passage 203. Air pressure in the leak-proof passage 203 acts on the air release valve head 30 (as shown in FIG. 4) so that the valve port 211 is closed by the air release valve head 30. That means the leak-proof passage 203 is equal to one air outlet passage 202 corresponding to the cavity 111 but the leak-proof passage 203 is unable to let the air move to the outside.

More specifically, at least two air inlet passages 201, at least one air outlet passage 202 and at least one leak-proof/sealing passage 203 are formed in the pump body 20. The air inlet passages 201, the air outlet passage 202 and the leak-proof passage 203 are selectively communicating with the cavity 111.

Figure 2:
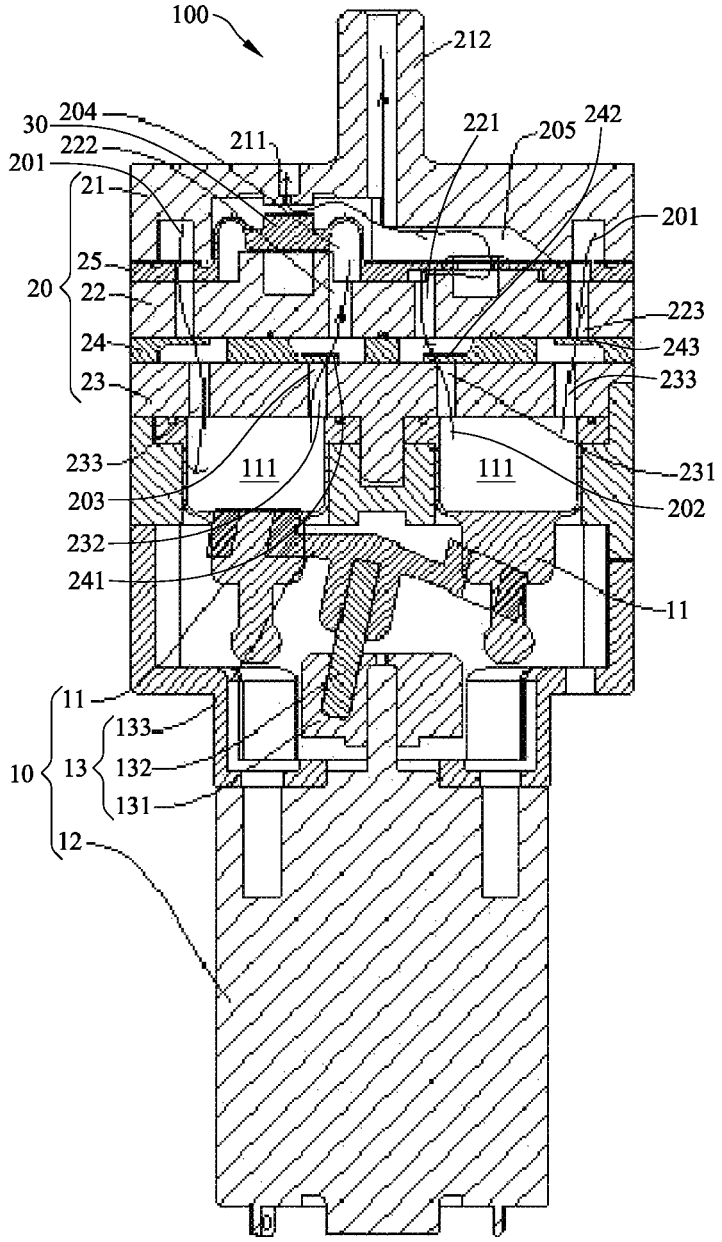
FIG. 2 is another sectional view of an embodiment according to the present invention.
Figure 3:
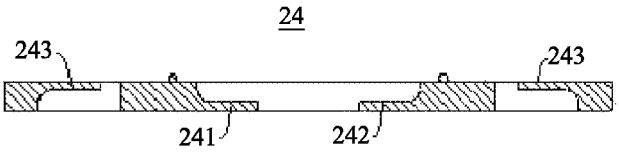
FIG. 3 is a sectional view of a first valve membrane of an embodiment according to the present invention.

In order to learn the working principle of the present diaphragm pump 100 more clearly, take an embodiment in which the bladder 11 includes only two cavities 111 as an example for detailed description. Refer to FIG. 1 and FIG. 2, one cavity 111 (the first cavity 111) is disposed corresponding to one air inlet passage 201 and one air outlet passage 202 while the other cavity 111 (the second cavity 111) is arranged corresponding to one air inlet passage 201 and one leak-proof passage 203. When the pump device 10 pumps air into the pressurizing device, the first cavity 111 and the second cavity 111 are compressed and expanded alternatingly. The air pressure of the leak-proof passage 203 always acts on the air release valve head 30 (as a pressure relief valve plate) to ensure the air release valve head 30 is closely attached to an inlet of the valve port 211 for preventing air leakage from the valve port 211. When the pump device 10 stops pumping and delivering air to the pressurizing equipment, the air inlet passage 201 and the air outlet passage 202 corresponding to the first cavity 111 are not communicating with the outside and so are the air inlet passage 201 and the leak-proof passage 203 corresponding to the second cavity 111. At the moment, air pressure which acts on the valve port 211 is gradually decreased so that the air release valve head 30 is gradually moved away from the valve port 211 and the valve port 211 is open. Air from the pressurizing equipment is passed through the air vent and flowing reversely to be released through the valve port 211.

Under the condition that the pump device 10 is pumping air to the outside, the air pressure in the leak-proof passage 203 is lower than that in the object being inflated when the pressure in the object being inflated is increased. This is due to the air release valve head 30. Under the action of pressure difference, the air release valve head 30 and the valve port 211 are separated and air flow can flow out through the valve port 211. Thus protecting the inflated object from overpressure is achieved and a rupture of the inflated object caused by over inflation is completely avoided. Moreover, automatic air release is achieved through the air release valve head 30 disposed on the diaphragm pump 100 while the diaphragm pump 100 stops working.

The diaphragm pump 100 provides both air pump and air release functions by rational arrangement of the passage system of the pump body 20. Thus the performance of the diaphragm pump 100 is optimized and no air release valve is required for the pressurizing device during air release.

Figure 5:
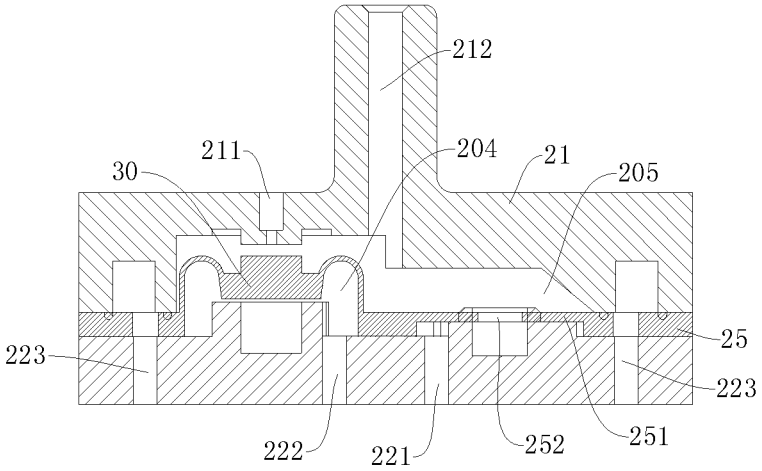
FIG. 5 is a sectional view of a top cover, a second valve membrane and a first valve seat of an embodiment according to the present invention.

As shown FIG. 1-3, FIG. 4, FIG. 5 and FIG. 6, the pump body 20 further includes a first valve seat 22 and a second valve seat 23. The air outlet passage 202 consists of a first air outlet channel 221 formed on the first valve seat 22 and a second air outlet channel 231 formed on the second valve seat 23. The leak-proof passage 203 is composed of a first leak-proof channel 222 formed on the first valve seat 22 and a second leak-proof channel 232 formed o the second valve seat 23. A first valve membrane 24 is located between the first valve seat 22 and the second valve seat 23 and is provided with a leak-proof valve plate 241 and an air outlet valve plate 242. The leak-proof valve plate 241 is mounted on an outlet of the second leak-proof channel 232 in a separable manner while the air outlet valve plate 242 is arranged at an outlet of the second air outlet channel 231 in a separable manner. As shown in FIG. 4 and FIG. 5, the first leak-proof channel 222 and the first air outlet channel 221 can be communicating with or not communicating with each other. The second valve seat 23 is disposed between the bladder 11 and the first valve membrane 24. As shown in FIG. 1, take this embodiment in which the first air outlet channel 221 and the first leak-proof channel 222 are often communicating with each other and the bladder 11 includes two cavities 111 as an example. When one of the cavities 111 draws air in, air flow enters the cavity 111 through the air inlet passage 201 corresponding to that cavity 111. At the moment, the leak-proof valve plate 241 is in contact with the outlet of the second leak-proof channel 232 to close the outlet of the second leak-proof channel 232 while the air outlet valve plate 242 is in contact with the outlet of the second air outlet channel 231 to close the outlet of the second air outlet channel 231. That means both the second leak-proof channel 232 and the second air outlet channel 231 are not communicating with the cavity 111. Now air in the other cavity 111 is forced out and the air inlet passage 201 corresponding to that cavity 111 is not communicating with the cavity 111. Now the leak-proof valve plate 241 is separated from the outlet of the second leak-proof channel 232 to open the outlet of the second leak-proof channel 232 or the air outlet valve plate 242 is moved away from the outlet of the second air outlet channel 231 to open the outlet of the second air outlet channel 231. That means both the second leak-proof channel 232 and the second air outlet channel 231 are communicating with the cavity 111. And a part of air flow from the cavity 111 flows to the second leak-proof channel 232 for maintaining air pressure in the second leak-proof channel 232 so that the air release valve head 30 is mated to the valve port 211 to close the valve port 211 and normal operation of the air release valve head 30 is ensured. Another part of the air flow is flowing out of the outlet of the second leak-proof channel 232 and passed through the first air outlet channel 221 and an air outlet duct 212 to be exhausted outside. Thereby utilization rate of the air flow is getting higher and this also improves air delivery efficiency.

As shown in FIG. 2, take this embodiment in which the first air outlet channel 221 and the first leak-proof channel 222 are not communicating with each other and the bladder 11 includes two cavities 111 as an example. When the air is drawn into one of the cavities 111, air flow enters the cavity 111 through the air inlet passage 201 corresponding to that cavity 111. At the moment, the leak-proof valve plate 241 is in contact with the outlet of the second leak-proof channel 232 to close the outlet of the second leak-proof channel 232 while the air outlet valve plate 242 is in contact with the outlet of the second air outlet channel 231 to close the outlet of the second air outlet channel 231. That means both the second leak-proof channel 232 and the second air outlet channel 231 are not communicating with the cavity 111. The air in the other cavity 111 is pushed out and the air inlet passage 201 corresponding to that cavity 111 is not communicating with the cavity 111. The leak-proof valve plate 241 is separated from the outlet of the second leak-proof channel 232 to open the outlet of the second leak-proof channel 232 or the air outlet valve plate 242 is moved away from the outlet of the second air outlet channel 231 to open the outlet of the second air outlet channel 231. When the air outlet valve plate 242 is moved away from the outlet of the second air outlet channel 231 to open the outlet of the second air outlet channel 231, air flow is passed through the second air outlet channel 231 and the first air outlet channel 221 to flow out from the air outlet duct 212. When the leak-proof valve plate 241 is separated from the outlet of the second leak-proof channel 232, air flow flows from the second leak-proof channel 232 to the first leak-proof channel 222 for providing pressure to the air release valve head 30. Thus the air release valve head 30 is in contact with the valve port 211 to close the valve port 211.

Preferably, the leak-proof passage 203 is communicating with the external environment outside the diaphragm pump 100 so that air in the leak-proof passage 203 can flow to the outside to avoid a rupture of leak-proof valve plate 241 caused by overpressure in the leak-proof passage 203. Thus the reliability of the diaphragm pump 100 is increased.

The leak-proof valve plate 241 and the air outlet valve plate 242 are both designed into a one-way valve and such design is beneficial to leak-tightness and stability of the diaphragm pump 100.

Refer to FIG. 1-3, FIG. 7 and FIG. 8, the first valve membrane 24 is further provided with an air-intake valve plate 243. The air inlet passage 201 includes a first air intake channel 223 formed on the first valve seat 22 and a second air intake channel 233 formed on the second valve seat 23. The air-intake valve plate 243 is mated to an outlet of the first air intake channel 223 in a separable manner. When the air-intake valve plate 243 is separated from the outlet of the first air intake channel 223, the first air intake channel 223 and the second air intake channel 233 are communicating with each other. Thus air is drawn into the cavity 111 corresponding to the air inlet passage 201. When the air-intake valve plate 243 is in contact with the outlet of the first air intake channel 223, the first air intake channel 223 and the second air intake channel 233 are not communicating with each other. Thus air in the cavity 111 corresponding to the air inlet passage 201 is exhausted.

The above embodiment is only for explanatory purposes only and is not meant to limit the scope of the present invention. For example, the air-intake valve plate 243 can also be mated to an inlet of the second air intake channel 233 in a separable manner.

In an embodiment of the present invention, as shown in FIG. 1, FIG. 2, FIG. 4, and FIG. 5, a second valve membrane 25 is arranged between the top cover 21 and the first valve seat 22. A pressure chamber 204 communicating with the leak-proof passage 203 is defined and formed between one side of the second valve membrane 25 and the first valve seat 22 while an air outlet chamber 205 is defined and formed between the other side of the second valve membrane 25 and the top cover 21. The air release valve head 30 is integrally formed on the second valve membrane 25. The air outlet chamber 205, the air outlet passage 202 and the air outlet duct 212 are communicating with one another. Thereby air from the cavity 111 flows from the air outlet passage 202 to the air outlet chamber 205 to be exhausted through the air outlet duct 212. And/or air from the cavity 111 passes through the leak-proof passage 203 and flows into the pressure chamber 204 for supplying and maintaining the pressure continuously so that the valve port 211 keeps close by the air release valve head 30. Moreover, the pressure chamber 204 and the air outlet chamber 205 are disposed on the two sides of the second valve membrane 25, respectively for buffering pressure. When the pressure in the pressure chamber 204 is in excess of the normal pressure, the air release valve head 30 is away from the valve port 211 so that the valve port 211 is opened for pressure relief. Thereby the pump curve of the present diaphragm pump 100 becomes more stable. Moreover, owing to the integration of the second valve membrane 25 with the air release valve head 30, not only assembly and production processes are simplified, the efficiency of the diaphragm pump 100 is also improved.

The above embodiment is only for explanatory purposes only and is not meant to limit the scope of the present invention. For example, the second valve membrane 25 and the air release valve head 30 can be manufactured separately.

In a preferred embodiment, as shown in FIG. 1, FIG. 2, and FIG. 4-8, the first valve seat 22 is further provided with a first boss 224 and a first indentation 225 recessed from the surface of the first boss 224. The arrangement of the first boss 224 is used for supporting the air release valve head 30 so as to form the pressure chamber 204 between the first valve seat 22 and the air release valve head 30. By such design, the air release valve head 30 is getting closer to the valve port 211. Thus the travel of the air release valve head 30 is reduced and this is beneficial to the thinner design of the air release valve head 30. The air release valve head 30 is getting lighter and easier to be mated to the valve port 211 under the action of the pressure in the pressure chamber 204. As to the first indentation 225, a certain amount of air can be stored therein. Thus there is still a certain air pressure worked on the air release valve head 30 when the cavity 111 corresponding to the leak-proof passage 203 is expanded. The first valve seat 22 can also have more compact design to reduce both material loss and production cost.

In a preferred embodiment, as shown in FIG. 1, FIG. 2, and FIG. 4-8, the first valve seat 22 is further provided a second boss 226 and a projection 227 is disposed on the second boss 226. The second valve membrane 25 is provided with a thinner portion 251 attached to a top surface of the second boss 226 correspondingly. The thinner portion 251 is concave from one side to the other side of the second valve membrane 25 and is provided with a through hole 252. The projection 227 is inserted through the through hole 252 of the second valve membrane 25 to be connected to the second valve membrane 25. Thereby the assembly stability and assembly efficiency of the first valve seat 22 with the second valve membrane 25 are both increased so that the first valve seat 22 and the second valve membrane 25 are connected more firmly.

The above embodiment is only for explanatory purposes only and is not meant to limit the scope of the present invention. For example, the first valve seat 22 and the second valve membrane 25 can be connected by glue.

In a preferred embodiment, as shown in FIG. 1, FIG. 2, FIG. 4 and FIG. 5, the thinner portion 251 is communicating with an outlet/outlet of the first air outlet channel 221. Understandably, the thickness of the thinner portion 251 smaller, suitable for deformation so that the through hole 252 and projection 227 can be mated with each other easily in a separable manner. While the air is discharged, the air flow flows from the outlet of the first air outlet channel 221 to the thinner portion 251. Under influence of pressure and impact force of the air flow, the thinner portion 251 is moved away from the first air outlet channel 221 and the through hole 252 is separated from the projection 227. Thereby the first air outlet channel 221 and the through hole 252 are communicating with each other. Then the first air outlet channel 221 is further communicating with the air outlet chamber 205. After stopping air-discharge for a period of time, the pressure in the air outlet chamber 205 is larger than the pressure in the first air outlet channel 221. Owing to the pressure difference, the thinner portion 251 is deformed so that the through hole 252 is mated to the projection 227 again. Therefore backflow of the air can be avoided.

The height of the projection 227 affects the anti-backflow effect of the diaphragm pump 100. When the height of the projection 227 is at a higher level, the amount of deformation of the thinner portion 251 is insufficient to separate the through hole 252 from the projection 227. Thus the through hole 252 is unable to be communicating with the first air outlet channel 221. When the height of the projection 227 is at a lower level, the connection tightness between the through hole 252 and the projection 227 is worse. Thus the air flow may flow back from the air outlet chamber 205 to the first air outlet channel 221.

According to the results of long term experiments, the diaphragm pump 100 has the most optimal pump curve when the height of the projection 227 is 0.15-0.8 millimeter (mm). Preferably, the optimal air release rate is achieved and the best user experience is provided when the height of the projection 227 is 0.45-0.55 mm and the diameter of the valve port 211 is 0.2-0.6 mm.

Figure 6:
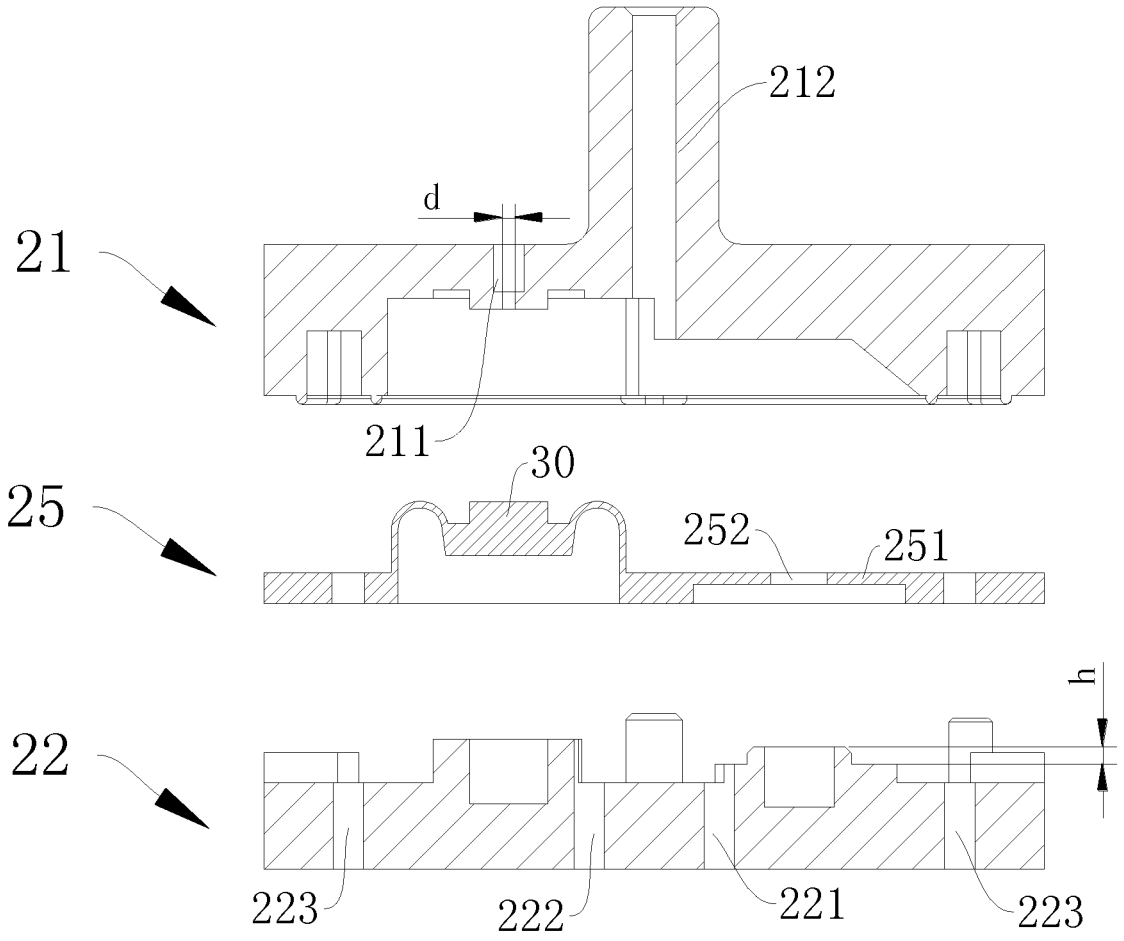
FIG. 6 shows sectional views of a top cover, a second valve membrane and a first valve seat of an embodiment according to the present invention.

In a preferred embodiment, as shown in FIG. 6, the height (h) of the projection 227 is 0.15-0.8 mm. That means the interference of the first valve seat 22 and the second valve membrane 25 is 0.15-0.8 mm. For example, the height of the projection 227 can be 0.15 mm, 0.3 mm, 0.45 mm, 0.6 mm, or 0.8 mm.

In a preferred embodiment, as shown in FIG. 6, the height (h) of the projection 227 is 0.45-0.55 mm. For example, the height of the projection 227 can be 0.45 mm, 0.48 mm, 0.5 mm, 0.52 mm, 0.53 mm, or 0.55 mm.

In a preferred embodiment, as shown in FIG. 6, the diameter (d) of the valve port 211 is ranging from 0.2 mm to 0.6 mm. For example the diameter of the valve port 211 can be 0.2 mm, 0.3 mm, 0.4 mm, 0.5 mm, or 0.6 mm. When the diameter of the valve port 211 is set at 0.2-0.6 mm, the air release efficiency of pressurizing equipment is increased and the user experience is improved.

Figure 7:
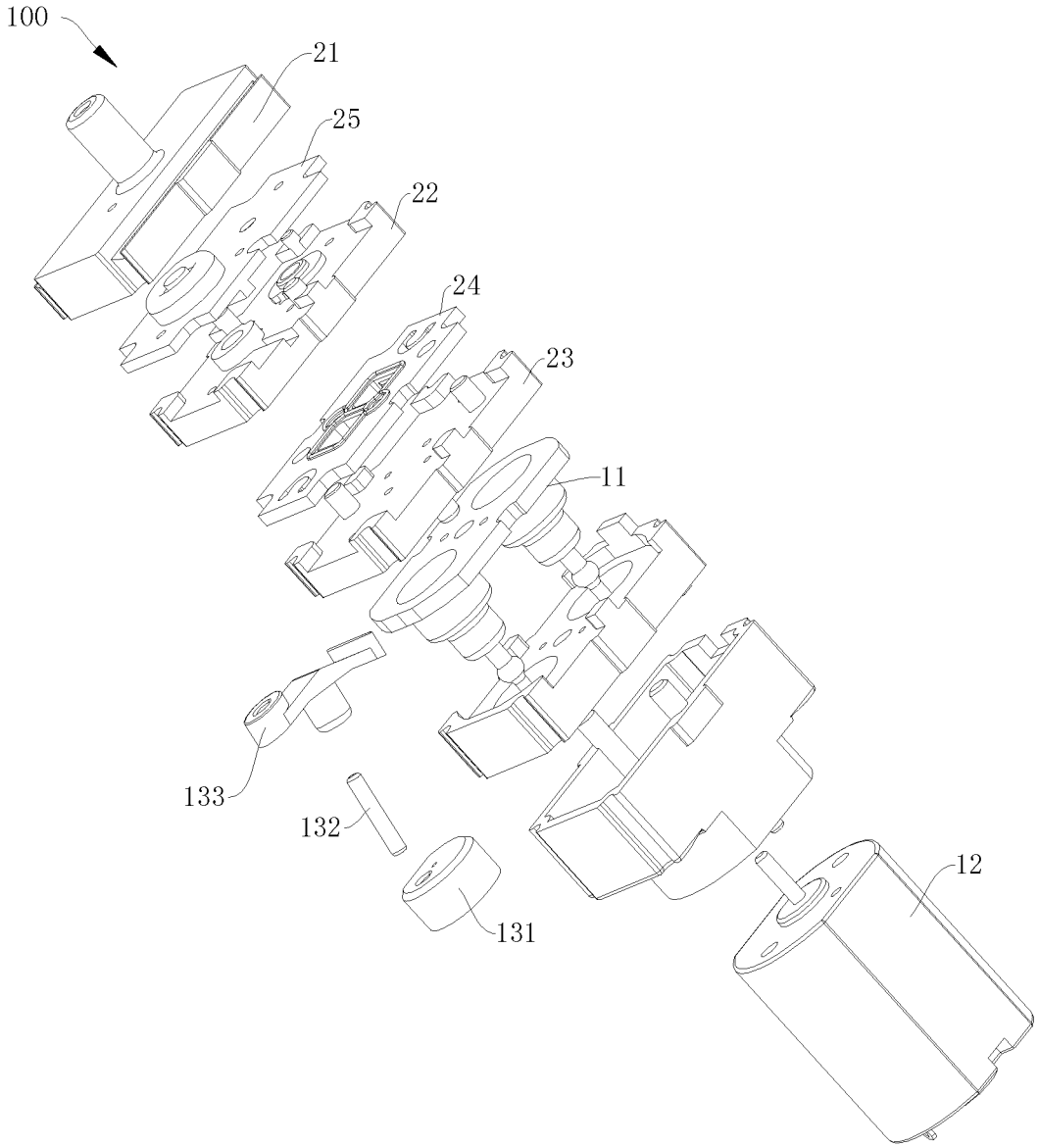
FIG. 7 is an explosive view of an embodiment according to the present invention.
Figure 8:
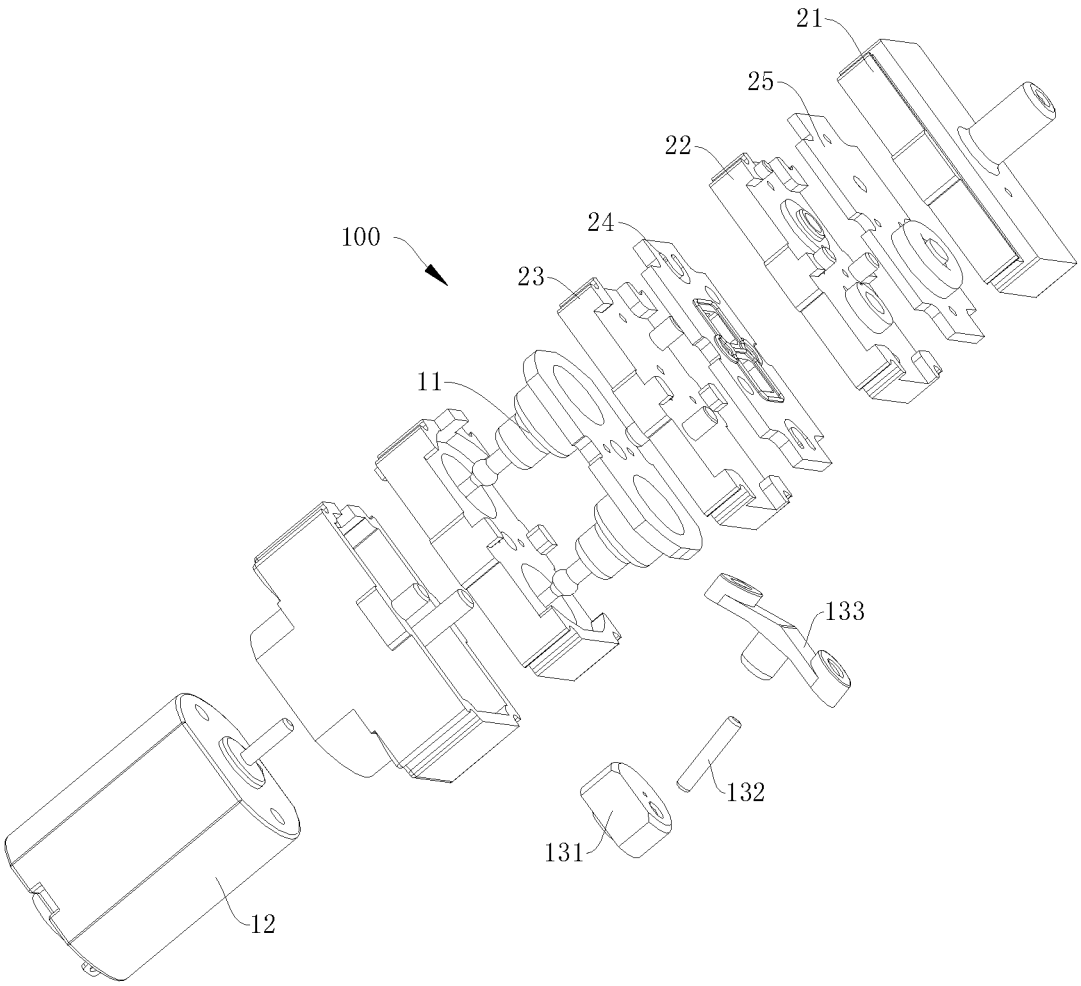
FIG. 8 is another explosive view of an embodiment according to the present invention.
Figure 9:
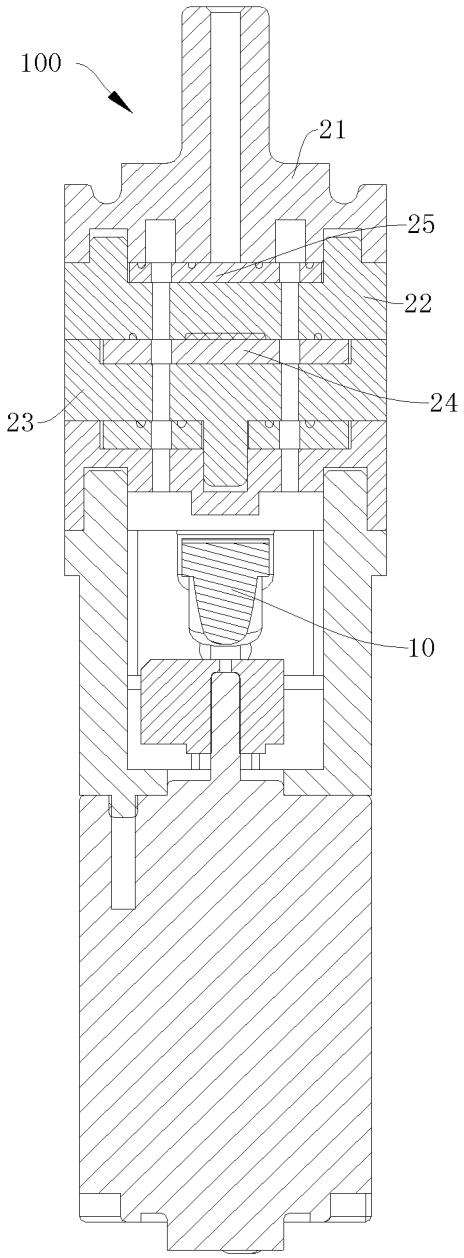
FIG. 9 is a sectional view of an embodiment according to the present invention.

In a preferred embodiment, as shown in FIG. 4, FIG. 7, and FIG. 8, a gap structure is disposed between the second valve membrane 25 and the first valve seat 22. The gap structure consists of a rib 253 and a second slot 228 mated to each other. One of the rib 253 and the second slot 228 is arranged at the second valve membrane 25 while the other one is disposed on the first valve seat 22. The gap structure in which the rib 253 and the second slot 228 are mated is communicating with the pressure chamber 204. The second slot 228 is communicating with the external environment outside the diaphragm pump 100. Once the pressure in the pressure chamber 204 is over the normal value, the second valve membrane 25 is lifted by the pressure so that the rib 253 and the second slot 228 are separated from each other. The air can be released to the outside environment through the gap between the rib 253 and the second slot 228 for pressure relief. The design can also protect the second valve membrane 25 from damages and cracks.

The above embodiment is only for explanatory purposes only and is not meant to limit the scope of the present invention. For example, the first valve seat 22 can be provided with a pressure relief hole which is communicating with the first leak-proof channel 222.

The above description is only the preferred embodiments of the present invention, and is not intended to limit the present invention in any form. Although the invention has been disclosed as above in the preferred embodiments, they are not intended to limit the invention. A person skilled in the relevant art will recognize that equivalent embodiment modified and varied as equivalent changes disclosed above can be used without parting from the scope of the technical solution of the present invention. All the simple modification, equivalent changes and modifications of the above embodiments according to the material contents of the invention shall be within the scope of the technical solution of the present invention.

What is claimed is:

1. A diaphragm pump comprising: a pump device which includes a bladder and an electromechanical member; at least two cavities formed in the bladder and a shaft of the electromechanical member connected to the bladder for driving the cavities to move upward and downward so that the cavities are compressed or expanded; a pump body which includes at least two air inlet passages, at least one air outlet passage and at least one leak-proof/sealing passage; each of the at least two air inlet passages, the at least one air outlet passage and the at least one leak-proof passage selectively communicating with at least one of the at least two cavities, wherein the pump body includes a top cover provided with a valve port, an air vent and an air outlet duct; and an air release valve head mated to the valve port in a separable manner; air pressure in the at least one leak-proof passage acting on the air release valve head so that the valve port is closed by the air release valve head while the pump device is pumping air; the air release valve head and the valve port separated from each other when the pump device stops pumping air, wherein the diaphragm pump includes a first valve seat and a second valve seat; the at least one air outlet passage comprised of a first air outlet channel formed on the first valve seat and a second air outlet channel formed on the second valve seat while the at least one leak-proof passage includes a first leak-proof channel formed on the first valve seat and a second leak-proof channel formed on the second valve seat; a first valve membrane is located between the first valve seat and the second valve seat and is provided with a leak-proof valve plate and an air outlet valve plate; the leak-proof valve plate is mated to an outlet of the second leak-proof channel in a separable manner while the air outlet valve plate is arranged at an outlet of the second air outlet channel in a separable manner; the first leak-proof channel and the first air outlet channel are able to be communicating with and not communicating with each other.

2. The diaphragm pump as claimed in claim 1, wherein the first valve membrane is further provided with an air-intake valve plate; each of the at least two air inlet passages includes a first air intake channel formed on the first valve seat and a second air intake channel formed on the second valve seat; the air-intake valve plate is mated to an outlet of the first air intake channel in a separable manner.

3. The diaphragm pump as claimed in claim 1, wherein a second valve membrane is arranged between the top cover and the first valve seat; a pressure chamber communicating with the at least one leak-proof passage is defined and formed between a first side of the second valve membrane and the first valve seat while an air outlet chamber is defined and formed between a second side of the second valve membrane and the top cover; the air release valve head is integrally formed on the second valve membrane.

4. The diaphragm pump as claimed in claim 3, wherein a first boss used for supporting the air release valve head is disposed on the first valve seat and a surface of the first boss is recessed to form a first indentation.

5. The diaphragm pump as claimed in claim 3, wherein a gap structure is disposed between the second valve membrane and the first valve seat and is composed of a rib and a second slot mated to each other; one of the rib and the second slot is arranged at the second valve membrane while the other one of the rib and the second slot is disposed on the first valve seat; the gap structure in which the rib and the second slot are mated is communicating with the pressure chamber.

6. The diaphragm pump as claimed in claim 1, wherein the diameter of the valve port is ranging from 0.2 mm to 0.6 mm.

* * * * *